United States Patent [19]

Kohrt et al.

[11] 4,235,957

[45] Nov. 25, 1980

[54] THERMAL SILVER-DYE BLEACH ELEMENT AND PROCESS

[75] Inventors: Carl F. Kohrt, Pittsford; Roland G. Willis, Rochester, both of N.Y.

[73] Assignee: Eastman Kodak Company, Rochester, N.Y.

[21] Appl. No.: 6,961

[22] Filed: Jan. 25, 1979

[51] Int. Cl.[2] ..... G03C 1/48; G03C 7/00

[52] U.S. Cl. ..... 430/203; 430/352; 430/353; 430/363; 430/371; 430/372; 430/390; 430/391; 430/393; 430/428; 430/429; 430/430; 430/431; 430/448; 430/559; 430/562; 430/619; 430/620; 430/336

[58] Field of Search ..... 96/53, 114.1, 67, 61, 96/20, 84, 99, 60 R, 66 T, 73, 29, 48 HD; 430/203, 352–353, 363, 371–372, 391–393, 429–431, 448, 559, 562, 619–620

[56] References Cited

U.S. PATENT DOCUMENTS

| | | | |
|---|---|---|---|
| 2,221,793 | 11/1940 | Gaspar | 96/53 |
| 2,564,238 | 8/1951 | Sprung | 96/53 |
| 2,612,448 | 9/1952 | Gáspár et al. | 96/73 |
| 2,882,156 | 4/1959 | Minsk | 96/84 |
| 3,178,290 | 4/1965 | Anderau | 96/73 |
| 3,178,291 | 4/1965 | Mory et al. | 96/99 |
| 3,183,225 | 5/1965 | Dreyfuss | 96/20 |
| 3,211,556 | 10/1965 | Anderau | 96/99 |
| 3,301,678 | 1/1967 | Humphlett et al. | 96/61 |
| 3,414,411 | 12/1965 | Michel et al. | 96/29 |
| 3,436,219 | 4/1969 | Ohyama et al. | 96/77 |
| 3,493,372 | 2/1970 | Gompf et al. | 96/73 |
| 3,709,690 | 1/1973 | Cohen et al. | 96/67 |
| 3,785,830 | 1/1974 | Sullivan et al. | 96/114.1 |
| 3,801,321 | 4/1974 | Evans et al. | 96/114.1 |
| 3,854,945 | 12/1974 | Bush et al. | 96/99 |
| 3,985,565 | 10/1976 | Gabrielson et al. | 96/114.1 |
| 4,022,617 | 5/1977 | McGuckin | 96/114.1 |
| 4,062,684 | 12/1977 | Hara et al. | 96/60 R |
| 4,123,273 | 10/1978 | Ciurca, Jr. et al. | 96/114.1 |
| 4,124,387 | 11/1978 | Kohrt | 96/114.1 |
| 4,124,398 | 11/1978 | Ciurca, Jr. et al. | 96/114.1 |

FOREIGN PATENT DOCUMENTS

| | | | |
|---|---|---|---|
| 923265 | 4/1963 | United Kingdom | 96/20 |
| 999996 | 7/1965 | United Kingdom | 96/20 |
| 1042300 | 9/1966 | United Kingdom | 96/20 |
| 1077628 | 8/1967 | United Kingdom | 96/20 |

OTHER PUBLICATIONS

Research Disclosure, Oct., 1976, pp. 18–21, Item 15026, de Mauriac.

Research Disclosure, Jun., 1977, pp. 80–81, Item 15869, Knight et al.

Research Disclosure, Jun., 1978, pp. 9–15, Item 17029, Carpenter et al.

Research Disclosure, Dec., 1971, pp. 107–110, Item 9232, Eastman Kodak Co.

The Focal Encyclopedia of Photography ©1969, McGraw-Hill, N.Y., N.Y., p. 109.

Research Disclosure, Apr., 1976, pp. 54–56, Item 14448, Anonymously disclosed.

History of Color Photography, Friedman (Ph.D), 405–409 ©1944, Am. Photographic Publ. Boston.

Some Features of the Silver-Dye Bleach Process Meyer, 90–97, J. of Photog. Sci., vol. 13, 1965.

Research Disclosure, Apr., 1976, pp. 30–32, Item 14433, Offedahl et al.

*Primary Examiner*—Travis Brown

*Attorney, Agent, or Firm*—Richard E. Knapp

[57] ABSTRACT

In a dry physical development photothermographic element for a dry thermal silver-dye bleach process wherein the element comprises a silver halide complexing concentration of a silver halide complexing agent improvements are provided when the complexing agent is an organic ammonium chloride, bromide or iodide. After imagewise exposure of the element, a dye image can be produced by uniformly heating the element. Improvements are also produced by providing a dry activator element for producing a dye image in a separate photographic element by means of a dry physical development thermal dye-bleach process, wherein the activator element comprises a support having thereon a layer comprising a synthetic hydrophobic polymeric binder, a silver halide complexing concentration of a silver halide complexing agent, as described, a bleachable dye and a thermal solvent.

36 Claims, No Drawings

THERMAL SILVER-DYE BLEACH ELEMENT AND PROCESS

BACKGROUND OF THE INVENTION

1. Field of the Invention

This invention relates to an improved dry physical development photothermographic element for a dry thermal silver-dye bleach process. In one of its aspects it relates to such a photothermographic element containing a silver halide complexing concentration of a certain silver halide complexing agent. In another of its aspects it relates to a dry activator element for producing a dye image by means of a dry physical development thermal silver-dye bleach process. A further aspect of the invention relates to a process of thermally dye bleaching an image in a dry physical development photothermographic element with a dry activator element.

2. Description of the State of the Art

It is well known to produce a silver image in a heat developable photographic material. Heat developable photographic materials are also known as photothermograhic materials. Heat developable photographic materials after imagewise exposure are heated to moderately elevated temperatures to provide a developed image without the need for separate processing solutions or baths. The heat development can provide a developed silver image in the material.

Many methods and materials for producing positive color images with photographic silver halide are also known. Methods which are known for producing color images include the silver-dye bleach process which has been described in several publications. Other processes for forming color images include reversal processes which involve the color development of photographic silver halide elements containing incorporated color-forming couplers. In each of these processes lengthy solution processing techniques have been required which rely heavily upon precision control and sophisticated processing techniques to produce color images. It has been desirable to avoid the need for processing solutions and baths in the silver dye-bleach process.

The silver-dye bleach process involves developing a silver image in an exposed photographic silver halide emulsion containing bleachable dye. After development of the silver image, bleaching of the dye is effected in those areas where the silver image has been developed. All the silver ion is removed or rendered transparent and insensitive to light by the bleach action leaving a positive dye image in the areas in which no metallic silver was present.

Thermal silver-dye bleach materials and processes have been proposed to overcome the problems encountered in solution processing involving photographic silver-dye bleach materials. Such thermal silver-dye bleach materials and processes are described in, for example, *Research Disclosure,* April 1976, pages 30–32, Item 14433 of Oftedahl, Mowrey and Humphlett, published by Industrial Opportunities Ltd., Homewell, Havant, Hampshire, P09 1EF, UK; and *Research Disclosure,* December 1976, pages 14–15, Item 15227 of Wu. One of the requirements of silver-dye bleach materials, including thermal silver-dye bleach materials, has been the need for an acid pH to produce the desired bleaching action. Typically, the pH of the materials in the past has been required to be less than 6.0 with a silver-dye bleach catalyst and in most cases less than 4.0. This low pH has caused increased decomposition of some of the components in the silver-dye bleach materials and caused reduced storage stability as well as difficulty in handling the very acidic materials.

It has also been desirable to provide a silver-dye bleach material useful for thermal processing, which avoids the need for a silver-dye bleach catalyst. A further problem which has been encountered involves the need for a wider range of effective dyes which are useful in the silver-dye bleach process, especially the thermal silver-dye bleach process. This is especially the case with dyes which are not irreversibly reduced to colorless materials. The thermal dye bleach materials in many cases provided suitable dye images; but, the materials have not provided suitable answers to these problems.

A further silver-dye bleach material has been proposed in U.S. Pat. No. 3,414,411 of Michael et al, issued Dec. 3, 1968. This material described in this patent is an "in-camera" type system in which a photographic element comprises a support having thereon a silver halide emulsion containing the salt of an acid and a developed silver image having in association therewith a bleachable dye or dye precursor. The exposed photographic emulsion is contacted with a viscous alkaline processing solution and with a web having a component which is capable of exchanging hydrogen ion with the cation of the salt of the acid present in the emulsion. The acid lowers the pH of the emulsion to a level at which imagewise bleaching of the dye can occur in areas where metallic silver and a silver complexing agent are present. The dye bleaching is conducted in the presence of a silver-dye bleach catalyst. This material encounters the problem described, such as the need for a strong acid component to produce the desired lower pH. In addition, the processing solution of Michael et al requires the use of salts which upon drying render the coating opaque due to crystallization. As a result, the web must be delaminated from the element for viewing of the image produced, according to Michael et al.

A continuing need has existed to provide a dry physical development photothermographic element for a dry thermal silver-dye bleach process and a dry activator element for producing a dye image by means of a dry physical development thermal silver-dye bleach process without the need for a thiourea silver halide complexing agent or similar silver halide complexing agent. Such elements should (1) avoid the need of providing an acid pH, such as an acid pH of 4.0 or less, and (2) avoid the need for a separate silver-dye bleach catalyst.

SUMMARY OF THE INVENTION

It has been found according to the invention that the described advantages are provided by means of a dry physical development photothermographic element for a dry thermal silver-dye bleach process wherein the element comprises a support having thereon (a) a first layer comprising photographic silver halide and (b), contiguous to the first layer, a second layer comprising a binder, a silver halide complexing concentration of a certain type of silver halide complexing agent and a thermal solvent, wherein the element also comprises a bleachable dye in reactive association with the photographic silver halide. The complexing agent for the silver halide comprises an organic ammonium chloride, bromide or iodide. After imagewise exposure of the photothermographic element, a dye image can be produced by a dry thermal silver-dye bleach process by heating the photothermographic element to a temperature within the range of about 90° C. to about 210° C., until the dye image is produced.

The advantages described can also be produced by means of a dry activator element for producing a dye image by a dry physical development, thermal silver-dye bleach process wherein the element comprises a support having thereon a layer comprising a binder, a silver halide complexing concentration of a silver halide complexing agent, a bleachable dye and a thermal solvent, wherein the element also comprises, as the silver halide complexing agent, an organic ammonium chloride, bromide or iodide, and also contains, as the binder, a synthetic, hydrophobic polymeric binder. After imagewise exposure and development of a silver image in a separate photographic element, a dye image can be produced in a thermal dye-bleach process by contacting the silver image with the dry activator element, just described, to form a "sandwich", and heating the resulting sandwich to an elevated temperature, such as a temperature within the range of about 90° C. to about 160° C., until a dye image is produced. The resulting dye image can also be thermally transferred to a dye image receiver.

The described photothermographic element and activator element avoid the need for components which lower the pH of the materials to less than 6.0, such as less than 4.0. This produces images which are more stable and elements which can have improved storage stability.

DETAILED DESCRIPTION OF THE INVENTION

The described photothermographic element and activator element according to the invention are dry. The process for producing a dye image in the silver-dye bleach process of the invention is also dry. The term "dry" herein is intended to refer to materials that are dry to the touch. A dry activator element, for example, is dry to the touch even though it may contain a small concentration of atmospheric moisture. The dry photothermographic element according to the invention is also dry to the touch. The photothermographic element and activator element, as described, can contain a concentration of atmospheric moisture which does not adversely affect the desired dye-bleach process. The activator element and the photothermographic element, as described, should contain neither water of hydration nor a concentration of water or other volatile material that is susceptible to vaporization during thermal processing. If an undesired concentration of moisture is present in or on the activator element, this moisture should be removed prior to thermal processing, such as by preheating the activator element to moderately elevated temperatures.

A variety of dry physical development photothermographic materials are useful according to the invention for producing a silver image. Typical dry physical development photothermographic materials comprise photosensitive silver halide in reactive association with an image-forming combination, preferably an oxidation-reduction image-forming combination, comprising (I) an organic silver salt oxidizing agent, with (II) a reducing agent, typically an organic reducing agent. It is necessary that the photosensitive silver halide, as described, and the image-forming combination, also as described, be in "reactive association" with each other in order to produce the desired image. The term "in reactive association", as employed herein, is intended to mean that the photosensitive silver halide and the image-forming combination and the described silver halide complexing agent are in a location with respect to each other which enables the desired development of a silver image and enables the desired silver-dye bleach process. It is believed that the latent image formed upon imagewise exposure of the photosensitive silver halide acts as a catalyst for the image-forming combination containing the organic silver salt and the reducing agent. In turn, the silver developed from such a combination is believed to enable the silver-dye bleach process to occur in the desired image areas of the element.

Typical components of dry physical development photothermographic elements which are useful according to the invention are described in, for example, U.S. Pat. No. 3,801,321 of Evans and McLaen; U.S. Pat. No. 3,785,830 of Sullivan, Cole and Humphlett; *Research Disclosure,* Volume 158, June 1977, Item 15869 of Knight, deMauriac and Graham; and *Research Disclosure,* Volume 150, October 1976, Item 15026 of deMauriac, each of which are incorporated herein by reference.

It is important that the described components of the photothermographic element and activator element according to the invention be non-volatile to help avoid release of undesired products at processing temperatures. The term "non-volatile" as used herein is intended to mean that no significant concentration of a component, as described, is vaporized from the photothermographic element or activator element according to the invention at processing temperature. Non-volatile components useful in the practice of the invention can be selected based, in part, on the boiling point of the components.

Components of the described photothermographic element and the activator element can be diffusible within the elements. That is, the components can be mobile or can be made mobile by means of a concentration of thermal solvent within the element. The term "thermal solvent" as employed herein is intended to mean a compound which upon heating to the described processing temperature produces an improved reaction medium, typically a molten medium, wherein the described image-forming combination can produce a better image upon development. The exact nature of the reaction medium in the photothermographic element and the activator element at processing temperatures described is not fully understood; however, it is believed that at the reaction temperatures a melt occurs which permits the reaction components to better interact. Examples of useful thermal solvents include methyl anisate, acetamide, 1,8-octane diol, beeswax and subaric acid.

In most cases the measurement of pH of a photo-thermographic element and activator element according to the invention is not suitable because the elements are substantially hydrophobic. However, if pH measurement is necessary, surface pH measurements by means of techniques known in the analytical chemical art can be useful.

The dry physical development photothermographic elements according to the invention comprise a photosensitive component consisting essentially of photosensitive silver halide. The photosensitive silver halide is especially useful due to its high degree of photosensitivity. A typical concentration of photosensitive silver halide in a dry physical development photothermographic element according to the invention is within the range of about 0.005 to about 5.0 moles of photosensitive silver halide per mole of the described organic silver salt oxidizing agent in the photothermographic element. For example, a typical concentration of photosensitive silver halide in a dry physical development photothermographic element is within the range of about 0.005 to about 0.50 mole of photosensitive silver halide per mole of silver behenate. Other photosensitive materials can be used in combination with the described photosensitive silver halide if they do not adversely affect the desired silver-dye bleach process. Preferred photosensitive silver halides are silver chloride, silver bromide, silver bromoiodide, silver chlorobromoiodide or mixtures thereof. A wide range of grain size of photosensitive silver halide from very coarse-grain to very fine-grain silver halide is useful. Selection of an optimum image-forming combination, optimum bleachable dye, and optimum silver halide complexing agent will be influenced by the particular photosensitive silver halide and the particular properties of the silver halide grains.

The photosensitive silver halide can be prepared by any of the procedures known in the photographic art. Useful procedures and forms of photosensitive silver halide for purposes of the invention are preferably those which are useful for hydrophobic photographic compositions. The photosensitive silver halide, as described, can be washed or unwashed, can be chemically sensitized using chemical sensitization procedures and materials known in the art, can be protected against the production of fog and stabilized against loss of sensitivity during keeping as described in, for example, the *Product Licensing Index,* Volume 92, December 1971, Publication 9232 on page 107.

A variety of silver halide complexing agents which are organic ammonium chloride, bromide or iodide compounds may be used in the elements according to the invention. Useful silver halide complexing agents according to the invention include those represented by the structures:

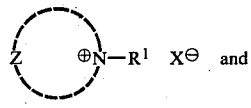

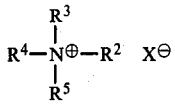

wherein Z represents the non-metallic atoms, especially carbon atoms and nitrogen atoms, which, together with N, are necessary to complete a heterocyclic nucleus, such as a 5-member or 6-member heterocyclic nucleus, including, for instance, pyrazine, pyridine, pyrroline, pyrrolidine, piperidine, imidazole, and pyrimidine heterocyclic nuclei; $R^1$ is alkyl containing 1 to 15 carbon atoms, such as alkyl containing 1 to 4 carbon atoms including, for instance, methyl, ethyl, propyl and octyl, or aryl containing 6 to 10 carbon atoms, including phenyl and naphthyl; and, $R^2$, $R^3$, $R^4$ and $R^5$ are, individually alkyl containing 1 to 4 carbon atoms, including methyl, ethyl, propyl and butyl. The described alkyl and aryl can be unsubstituted or can be substituted with groups which do not adversely affect the desired dye-bleach process. $R^1$ can be, for instance, aralkyl containing up to 15 carbon atoms, such as phenethyl and phenylpropyl. Examples of substituents which do not adversely affect the silver-dye bleach process include phenyl and methyl on the described alkyl and aryl as well as those groups illustrated in the following examples.

Examples of useful silver halide complexing agents according to the invention include:

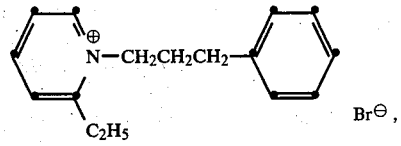

(designated herin as complexing agent A)

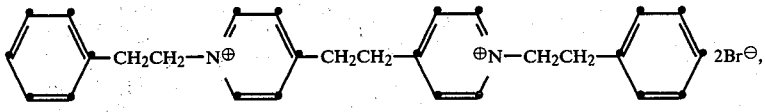

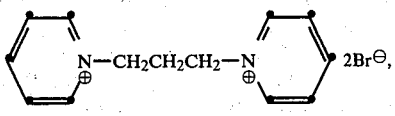

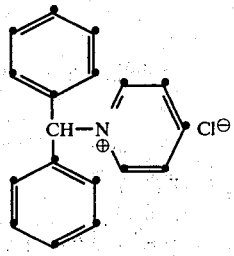

-continued

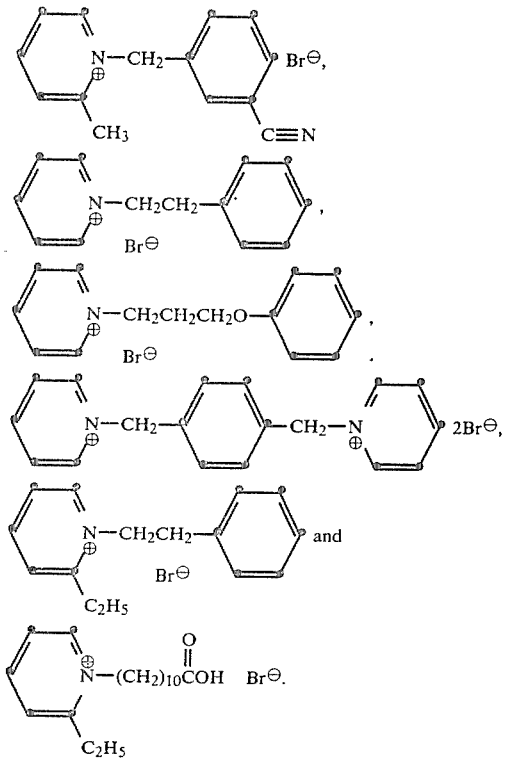

If desired, combinations of the described silver halide complexing agents can be used in the described photothermographic element and activator element. An example of a combination of complexing agents is the combination of pyrazine with complexing agent A.

It is necessary that a silver halide complexing concentration of the described silver halide complexing agent be present in the photothermographic element or activator element according to the invention in order to produce the desired silver-dye bleach reaction. A silver halide complexing concentration of the silver halide complexing agent should be sufficient to change the potential of the photothermographic material in favor of oxidizing $Ag^{\circ}$ to $Ag^{+}$. A useful silver halide complexing concentration of a described silver halide complexing agent according to the invention is typically within the range of about 0.5 mole to about 4 moles of the described silver halide complexing agent per mole of $Ag^{+}$ the photothermographic element or activator element according to the invention. An especially useful concentration of silver halide complexing agent, as described, is within the range of about 2 to about 4 moles of the silver halide complexing agent per mole of $Ag^{+}$. The optimum silver halide complexing concentration of the silver halide complexing agent can be determined based upon such factors as the desired image, the particular silver halide complexing agent or silver halide complexing agent combination, the particular photosensitive silver halide, processing conditions, other components of the photothermographic element and activator element and the like.

In the past is was considered necessary to have a silver-dye bleach catalyst present in an activator element to produce the desired silver-dye bleach result when the effective pH of the element was higher than about 4.0. A silver-dye bleach catalyst is not necessary in the photothermographic element and activator element according to the invention. However, if in some cases it is desirable, a silver-dye bleach catalyst can be added to the photothermographic element or activator element. For instance, in some cases it can be useful to add a concentration of such silver-dye bleach catalysts as phenazine, quinoxaline, anthraquinone, or pyrazine. These compounds can, in some cases, aid in oxidation of the metallic silver to silver ion. The reduced catalysts can cross-oxidize with the image dye. This cross-oxidation can be catalyzed, i.e. bleach the image dye and oxidize the catalyst back to its original state.

The described activator element according to the invention can be prepared by coating procedures known in the photographic art. The various components can be coated from a suitable solvent such as methanol, ethanol, acetone and the like. The various components can be coated in the same layer or in different contiguous layers. Such coating procedures are also useful for producing the described photothermographic element.

The silver image in a photothermographic element according to the invention can be produced by a variety of means. The silver image is typically produced by imagewise exposure of the photothermographic element to produce a latent silver image. A variety of exposure means is useful for this purpose. A latent image is typically produced by imagewise exposure to electromagnetic radiation which includes visible light. A latent image can also be produced by imagewise exposure with, for instance, ultraviolet radiation, infrared radiation, lasers, electrical energy and the like. The exposure should be sufficient to produce a developable latent image in the described photothermographic element.

After imagewise exposure of the photothermographic element of the invention, a dye image can be produced in the photothermographic element by uniformly heating the element to moderately elevated temperatures, such as a temperature within the range of about 90° C. to about 160° C. The photothermographic element is heated within the described range for a time sufficient to produce a dye image, typically for about 15 seconds to about 300 seconds. By increasing or decreasing the length of time of heating, a higher or lower temperature within the described range can be useful depending upon such factors as the desired image, the particular components of the photothermographic element, and the like. A dye image is typically produced within 30 seconds at a processing temperature within the range of about 110° to about 135° C.

Any suitable means can be used for producing the desired processing temperature. The heating means can be, for example, a simple hot plate, iron, roller or the like.

Processing is typically carried out under ambient conditions of pressure and humidity. Conditions outside normal atmospheric pressure and humidity can be employed if desired.

The activator element, as described, can be placed in contact with a dry physical development photothermographic element in which a silver image has already been developed prior to contacting the activator element with the photothermographic element. Alternatively, the activator element according to the invention can be laminated to the dry physical development photothermographic element prior to overall heating the combined elements to produce a desired dye image. After processing the activator element can be removed, such as by stripping, from the dry physical development photothermographic element if desired. However, in many cases it is not necessary to separate the activator element from the photothermographic element after heating as described.

An example of an especially useful embodiment of the invention is a dry physical development photothermographic element for a dry thermal silver-dye bleach process wherein the element comprises a support having thereon (A) a first layer comprising photographic silver halide and (B), contiguous to the first layer, a second layer comprising a polymeric binder, a silver halide complexing concentration of a silver halide complexing agent and a thermal solvent, and wherein the element also comprises a bleachable dye in reactive association with the photographic silver halide. In this embodiment, the improvements according to the invention comprise, in combination, (a) as the complexing agent a compound consisting essentially of complexing agent A represented by the structure:

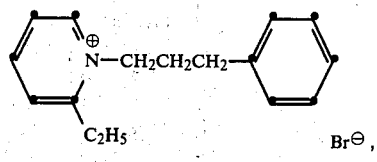

(b) and in the first layer (A), (i) an oxidation-reduction image-forming combination comprising (I) silver behenate, with (II) a phenolic, silver halide developing agent, and (ii) a binder, as described, especially a poly(vinyl butyral) binder, and (c), as the polymeric binder in the second layer (B), a poly(vinyl butyral) binder.

A variety of bleachable dyes may be used in the described photothermographic element and activator element according to the invention. The term "bleachable dye" as used herein includes compounds which are dye precursors, that is colorless compounds which become colored during processing of the photothermographic element or activator element, and shifted dyes which shift hypsochromically or bathochromically to the desired image hues during the described silver-dye bleach process according to the invention. The bleachable dyes can be diffusible or non-diffusible. The term "non-diffusible" as used herein refers to bleachable dyes which in themselves are nondiffusible in the photothermographic element or activator element, or dyes which are rendered nondiffusible such as by the use of a suitable mordant. A variety of mordants may be used such as mordants described in U.S. Pat. No. 2,882,156.

The photothermographic element and activator element of the invention can have a single layer for monochrome dye images formed from either one or a mixture of dyes. The dye images can be either colored or neutral or nearly neutral (black) appearing images.

Typically useful bleachable dyes according to the invention include compounds which are bleachable azo, indophenol, indoaniline and anthraquinone dyes. Especially useful dyes are azo dyes because the bleaching process cleaves the azo double bond to produce two aromatic fragments. Typical azo dyes which can be useful according to the invention are described in, for example, U.K. Pat. Nos. 923,265; 999,996; 1,042,300; 1,077,628; and U.S. Pat. Nos. 3,178,290; 3,178,291; 3,183,225; and 3,211,556. Examples of useful indophenol dyes are described in U.S. Pat. No. 3,854,945 and following Example 1. Examples of useful indoaniline dyes are described in following Example 2. Also, examples of useful anthraquinone dyes are described in following Example 5. Each of the noted references is incorporated herein by reference. Useful bleachable dyes also include those known in the silver-dye bleach art and dyes such as disclosed in the Color Index "Third Edition" published by the Society of Dyers and Colourists, copyright 1971, printed by Lunt Humphreys, Bradford and London, with the provision that the dyes are bleachable as herein described. These bleachable dyes include those selected from formazan dyes, azoxy dyes, xanthene dyes, azine dyes, phenylmethane dyes, nitroso dyes, indigo dyes, nitro-substituted dyes, phthalocyanines and the like. Precursors to these described dyes are known in the art, such as, hydrazo or diazonium compounds which yield azo dyes and tetrazolium salts which yield formazan dyes. Precursors to the described dyes are also useful.

The useful bleachable dyes are defined herein as those dyes which in the presence of a silver metal image and a physical development image-forming combination, such as silver behenate with a phenolic reducing agent, at processing temperature undergo a discharge of their color proportionate to the amount of silver image metal present.

The photothermographic elements and activator elements according to the invention can have a plurality of coatings each containing a different bleachable dye for producing multicolor images. Useful arrangements are those in which at least three light sensitive emulsion layers are provided which are respectively sensitized to blue, green and red radiation, and contain, respectively, non-diffusible yellow, magenta and cyan bleachable dyes. One useful arrangement is a dry physical development photothermographic element comprising a support having coated thereon in the following order, layers containing, respectively, blue-sensitive silver halide; bleachable yellow dyes; green-sensitive silver halide; bleachable magenta dye; red-sensitive silver halide; and bleachable cyan dye.

The bleachable dyes can be added to the elements according to the invention by any of the methods known in the photographic art. For example, the bleachable dyes can be added as dispersions. The dyes can also be added in the form of latexes.

A range of concentration of the bleachable dye can be present in the described photothermographic element and the dry activator element. A typical concentration of bleachable dye is within the range of about 0.5 mmoles/$m^2$ to about 50 mmoles/$m^2$. The concentration should be at least sufficient to produce a discernible dye image upon processing. The optimum concentration of bleachable dye will depend upon such factors as the particular bleachable dye, particular components of the photothermographic element and the dry activator element, processing conditions, desired storage stability, desired image and the like.

A variety of organic silver salt oxidizing agents can be useful in the described photothermographic element. The silver salt oxidizing agent can be, for example, a silver salt of a long-chain fatty acid. The silver salt of the long-chain fatty acid should be resistant to darkening under illumination to help avoid undesired deterioration of a developed image. The term "long-chain" as employed herein is intended to mean a chain of carbon atoms containing at least 10 carbon atoms, typically 10 to 30 carbon atoms. An example of a useful class of silver salts of long-chain fatty acids includes those fatty acids containing at least 20 carbon atoms. Examples of useful silver salts of long-chain fatty acids include silver behenate, silver stearate, silver oleate, silver laurate, silver hydroxystearate, silver caprate, silver myristate and silver palmitate. Another class of useful organic silver salt oxidizing agents includes silver salts of certain 1,2,4-mercaptotriazole derivatives. Such silver salts of 1,2,4-mercaptotriazole derivatives are described in, for example, *Research Disclosure,* Volume 158, June 1977, Item 15869 of Knight, deMauriac and Graham. Such silver salts of 1,2,4-mercaptotriazole derivatives include, for instance, the silver salt of 3-amino-5-benzylthio-1,2,4-triazole. Another useful class of organic silver salt oxidizing agent is represented by the complexes of silver with certain nitrogen acids, such as nitrogen acids selected from the group consisting of imidazole, pyrazole, urazole, 1,2,4-triazole and 1H-tetrazole nitrogen acids. These silver salts of nitrogen acids are described in, for example, *Research Disclosure,* Volume 150, October 1976, Item 15026 of deMauriac, which is incorporated herein by reference. Examples of useful silver salts of nitrogen acids include the silver salts of 1H-tetrazole; dodecyltetrazole; 5-n-butyl-1H-tetrazole; 1,2,4-triazole; urazole; imidazole; and benzimidazole. A further class of useful organic silver salt oxidizing agents is represented by the silver salts of certain heterocyclic thione compounds. These heterocyclic thione compound silver salts are described, for example, in U.S. Pat. No. 3,301,678 of Sullivan, Cole and Humphlett. Examples of useful silver salts in this class include the silver salts of 3-(2-carboxyethyl)-4-methyl-4-thiazoline-2-thione and the silver salt of 3-carboxymethyl-4-methyl-4-thiazoline-2-thione.

Selection of an optimum organic silver salt oxidizing agent or organic silver salt oxidizing agent combination will depend upon such factors as the desired image, particular photosensitive silver halide, processing conditions, particular bleachable dye and the like.

Preparation of the described organic silver salt oxidizing agent is typically carried out ex situ, that is, separate from other components of the heat developable photothermographic element as described. In most instances, the preparation of the silver salt oxidizing agent will be separate from the other components based on the ease of control of preparation and storage stability.

The terms "salt" and "complex" as used herein are intended to include any type of bonding or complexing mechanism which enables the resulting material to produce desired imaging properties in the described photothermographic element. In some instances the exact bonding of the described organic silver salt oxidizing agent is not fully understood. Accordingly, the terms "salt" and "complex" are intended to include various complexes which enable the desired image-forming combination to provide the desired image. The terms "salt" and "complex" are intended to include neutral complexes and non-neutral complexes.

A variety of reducing agents may be used in the dry physical development photothermographic element according to the invention. The reducing agent is typically an organic reducing agent. The reducing agent should be sufficiently active to produce the desired physical development with the described silver salt oxidizing agent in the presence of the latent image silver. Examples of useful reducing agents include polyhydroxybenzenes such as hydroquinone developing agents including, for instance, hydroquinone, alkyl-substituted hydroquinones, exemplified by tertiary-butyl hydroquinone, methyl hydroquinone, 2,5-dimethyl hydroquinone and 2,6-dimethyl hydroquinone; catechols and pyrogallol; halo-substituted hydroquinone such as chloro hydroquinone and dichloro hydroquinone; alkoxy-substituted hydroquinone such as methoxy hydroquinone and ethoxy hydroquinone and the like. Other reducing agents which are useful include reductone developing agents such as anhydrodihydropiperidino hexose reductone; hydroxytetronic acid developing agents and hydroxytetronimide developing agents; 3-pyrazolidone developing agents such as 1-phenyl-3-pyrazolidone and 4-methyl-4-hydroxymethyl-1-phenyl-3-pyrazolidone; certain hydroxylamine developing agents; ascorbic acid developing agents such as ascorbic acid, ascorbic acid ketals and other ascorbic acid derivatives; phenylenediamine developing agents; certain aminophenol developing agents and the like. Combinations of reducing agents can also be useful. Especially useful reducing agents are phenolic reducing agents such as sulfonamidophenols.

A reducing agent or reducing agent combination can be useful within a range of concentration in the described photothermographic element. A typical concentration of reducing agent or reducing agent combination is within the range of about 0.1 mole to about 5 moles of reducing agent or reducing agent combination per mole of $Ag^+$ in the photothermographic element. The optimum concentration of reducing agent will depend upon such factors as the particular organic silver salt oxidizing agent, the particular photosensitive silver halide, processing conditions, desired image, particular bleachable dye and the like.

The photothermographic element typically comprises a binder in the described first layer with the photosensitive silver halide. A variety of binders may be used in this layer with the photosensitive silver halide.

Suitable binders are typically hydrophobic. They are also typically transparent or translucent and include synthetic polymeric substances which do not adversely affect the desired silver-dye bleach process. Useful binders include polyvinyl compounds like poly(vinyl pyrrolidone), and acrylamide polymers, as well as dispersed vinyl compounds such as in latex form and particularly those which increase dimensional stability of the photothermographic element. Useful binders include alkylacrylates and methacrylates and those which have crosslinking sites which facilitate hardening or curing as well as those having recurring sulfobetaine units. Especially useful binders include high molecular weight materials and resins such as poly(vinyl butyral), cellulose acetate butyrate, poly(methyl methacrylate), poly(vinyl pyrrolidone), ethyl cellulose, poly(styrene), poly(vinyl chloride), chlorinated rubber, poly(isobutylene), butadienestyrene copolymers, vinyl chloride-vinyl acetate copolymers, copolymers of vinyl acetate, vinyl chloride and maleic acid, poly(vinyl alcohol), and the like. Combinations of binders can be useful.

The polymeric binders are preferably synthetic, hydrophobic polymeric binders.

A variety of binders can be useful in layer (B) of the photothermographic element and in the dry activator element as described. Typically, the binder that is useful in the described second layer of the photothermographic element or in the dry activator element is the same binder as is in layer (A) of the photothermographic element. Polymers which are useful as binders in layer (B) of the photothermographic element and in the dry activator element are the same as those binders described for layer (A) of the photothermographic element. The selection of an optimum binder or binder combination for the layers of the photothermographic element and the dry activator element will depend upon such factors as the particular components of the photothermographic element, processing conditions, desired image and the like. Typical polymers which are useful as binders in the dry activator element include poly(vinyl butyral), cellulose acetate butyrate, sulfonated polystyrene, poly(acrylic acid), poly(acrylamide), poly(vinyl alcohol), poly(vinyl pyrrolidone), poly(ethylene oxide), and copolymers of acrylamide with ethyl 5-(m- and p-vinylphenyl)-3-oxo-pentanoate. The binders in the photothermographic element and the dry activator element should be sufficiently permeable at processing temperatures to permit the desired interaction between the described components to permit the desired silver-dye bleach process to occur.

The described photothermographic element and dry activator element according to the invention can comprise a variety of supports. Useful supports must be able to withstand the processing temperatures employed, such as processing temperatures within the range of about 90° C. to about 200° C. Useful supports include, for example, cellulose ester film, poly(vinyl acetal) film, polystyrene film, poly(ethylene terephthalate) film, polycarbonate film and related films or resinous materials, as well as glass, paper, metal and the like. Typically, a flexible support is most useful.

The photothermographic elements according to the invention can contain addenda and layers commonly found useful in photothermographic silver halide elements, such as antistatic and/or conducting layers, plasticizers and/or lubricants, surfactants, matting agents, brightening agents, light-absorbing materials, filter dyes, antihalation dyes and absorbing dyes and the like, such as described in *Research Disclosure,* Volume 170, June 1978, Item 17029, of J. W. Carpenter and P. W. Lauf.

The various components of the photothermographic element and the dry activator element can be added from suitable solutions such as suitable organic solvent solutions. The components can be added using various procedures known in the photographic art.

If desired, a toning agent, sometimes described as an activator-toning agent, can be useful in the described photothermographic element according to the invention to provide an increase in density of the silver image at certain processing temperatures. Useful toning agents include, for example, cyclic imide toning agents such as succinimide, 1-(2H)phthalazinone and the like. Combinations of toning agents can be useful.

Spectral sensitizing dyes can be useful in the described photothermographic element to confer additional sensitivity to the light-sensitive silver halide. For instance, additional spectral sensitization can be obtained by treating the silver halide with a solution of a sensitizing dye in an organic solvent or the dye can be added in the form of a dispersion. Spectral sensitizing dyes which can be useful include the cyanines, merocyanines, complex (trinuclear or tetranuclear) merocyanines, complex (trinuclear or tetranuclear) cyanines, holopolar cyanines, styryls, hemicyanines, such as enamines, oxonols and hemioxonols. These are described, for instance, in the *Product Licensing Index* Publication No. 9232 mentioned. Combinations of spectral sensitizing dyes can be useful.

A range of concentration of each component in the photothermographic element and the dry activator element can be useful. Typically, each light sensitive layer of the described photothermographic element according to the invention can comprise (1) about 1mmole to about 10 mmoles of silver as the described organic silver salt oxidizing agent, (2) 1 mmole to about 10 mmoles of the described photosensitive silver halide of support and (3) a reducing agent concentration which is at least sufficient to provide the desired development action. An optimum concentration of each component will depend upon such factors as the particular oxidizing agent, the particular reducing agent, the desired image, processing conditions, particular bleachable dye and the like.

The bleachable dye can be added directly to the photothermographic composition prior to coating on the described support or can be added to the photothermographic element after the photosensitive silver halide layer is coated on the support.

The layer containing the photosensitive silver halide and other layers of a photothermographic element and dry activator element according to the invention can be coated by various coating procedures including dip coating, airknife coating, curtain coating or extrusion coating using hoppers known in the photographic art. If desired, two or more layers can be coated simultaneously by procedures known in the art.

In some cases it can be convenient to produce a dye image in a photothermographic element according to the invention in a single heating step. In such cases it is often desirable to place a timing layer between the layer containing the photosensitive silver halide and the layer containing the silver halide complexing agent. This enables the dye bleaching step to be delayed until the silver image is developed upon heating the photothermographic element after imagewise exposure.

If desired, the dry activator element can be preheated to a state in which the layer containing the silver halide complexing agent is molten. The preheated element can enable release of excess moisture and prevent gas bubbles from forming prior to lamination to the element containing the silver image.

The photothermographic element according to the invention can be a diffusion transfer photothermographic element containing an image-receiving layer which is an integral part of the photothermographic element or is separable from the photothermographic element. The image-receiving layer can comprise a dye mordant. Selection of a useful dye image receiver will depend upon the particular dye image, processing conditions, particular components of the photothermographic element, and the like. Useful mordants typically comprise a polymeric ammonium salt such as one of those described in U.S. Pat. No. 3,709,690 of Cohen et al, issued Jan. 9, 1973.

The dye produced in the silver-dye bleach process in the described photothermographic element can be transferred into a suitable dye image receiver. For example, the dye produced in the silver-dye bleach process according to the invention can be transferred from the photothermographic element into a polyester dye image receiver, such as a polyester fabric. This transfer of dye can be produced, for example, by heating the photothermographic element, after dye image formation, while in contact with the dye image receiver. Typically, a thermal solvent is most useful to increase the desired transfer of the dye onto the dye receiver. The thermal solvent is typically an organic solid that melts at processing temperature and acts as a solvent for the dye and enables better transfer of the dye into the dye receiver. If desired, a stripping layer can be useful between the photothermographic element and the dye receiver. The photothermographic element then can be stripped easily from the dye image receiver.

The following examples are included for a further understanding of the invention.

In the following examples no effort was made to balance the equivalency of the dyes and the silver image. As a result, not all of the dye and all of the silver was bleached in each instance. The basic purpose of each example was to demonstrate the potential of the dye of the example to bleach the metallic silver and form a dye image in the element under the processing conditions and with the particular components of the element.

In each example two separate elements were prepared. Each element was imagewise exposed to produce a developable latent silver image and processed by heating the exposed element as described in each example.

The first element was designated as Element A and the second element was designated as Element B. Element A was prepared as follows:

A dispersion was prepared by ballmilling together the following components for 72 hours:

silver behenate: 33.6 g
behenic acid: 25.4 g
poly(vinyl butyral) (binder): 12.0 g
acetone-toluene (1:1 parts by volume) (solvent): 400 ml Three milliliters of this dispersion were added to a solution containing 0.3 millimoles (86 milligrams) of 1,1'-bi-2-naphthol (reducing agent) dissolved in 7 ml of a 2.0% by weight poly(vinyl butyral) solution in equal parts by volume acetone and toluene. 1.0 Milliliters of a photosensitive silver bromoiodide emulsion (6% iodide) in acetone and peptized with poly(vinyl butyral) was added to the resulting mixture with stirring.

The resulting photothermographic composition was coated at a 6 mil wet coating thickness at 54° C. onto a 4 mil thick poly(ethylene terephthalate) film support. The coating was permitted to dry. The resulting photothermographic element was then imagewise exposed to a light source (3200°K) for one second at a distance of 15 inches to produce a developable latent image in the photothermographic element. The exposed photothermographic element was then uniformly heated for 20 seconds by contacting the support side of the element on a metal block heated to 135° C. A negative silver image was developed in the photothermographic element.

The developed element was then washed for 2 minutes in methanol to remove remaining oxidized developer. This was done to help avoid any adverse affects that the oxidized developer might possibly have regarding the desired dye images produced in later steps.

The Element B was prepared as follows:

The photothermographic element described as Element A was prepared with the exception that the 1,1'-bi-2-naphthol (reducing agent) was replaced with 102 milligrams (0.3 millimoles) of the following reducing agent:

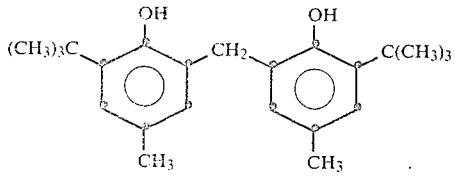

Ten milligrams of 1-(2H)phthalazinone was added to the composition of Element B also. 1-(2H)Phthalazinone was added to accelerate development of the image upon heating of the exposed element.

The same imagewise exposure and processing (uniform heating) was used for Element B as was used for Element A. This exposure and processing produced a negative silver developed image in Element B. The processed Element B was not washed in methanol because the oxidized reducing agent of Element B does not adversely affect the subsequent formation of dye images in the dye-bleach process of the invention.

EXAMPLE 1

Indophenol dyes in the silver-dye bleach process

Activator elements were prepared by coating a reducible indophenol dye, a silver halide complexing agent, a thermal solvent and a hydrophobic binder on a poly(ethylene terephthalate) film support.

The activator elements were prepared in the following manner: to 9 milliliters of a solution of 2.5% by weight poly(vinyl butyral) in 1:1 methanol-toluene (by volume) were added 2 milliliters of acetone, 250 milligrams of the following silver halide complexing agent:

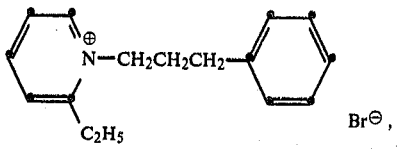

(Complexing Agent A)

1 gram of methyl anisate (thermal solvent) and 0.15 millimoles of the dye (listed in following Table I). The resulting composition was coated on the film support at 54° C. at a 6 mil wet coating thickness. The resulting coating was permitted to dry under ambient conditions.

The silver-dye bleach process was carried out by placing the activator element containing the dye in face-to-face contact with the processed photothermographic Element A containing the developed negative silver image. The resulting so-called sandwich, also described as a laminate, was then uniformly heated on a metal block for 2 minutes at 85° C. with the support side of Element A in contact with the heated metal block. (Either side of the resulting sandwich could be placed in contact with the heated block without noticeable differences in the results of the silver-dye bleach process). The dye which was added in each instance to the composition containing the silver halide complexing agent and the results of the silver-dye bleach process in each instance are listed in following Table I.

TABLE I

| Ex. No. | Dye | Results |
|---|---|---|
| 1a | 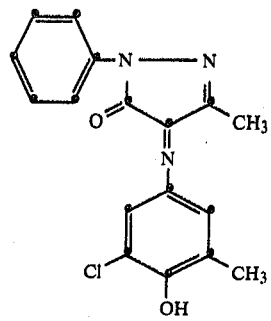 | Positive magenta image Dye density (to green light): Dmax 2.3 Dmin 1.6 Silver density (to IR radiation) reduced from 1.3 to 0.3 |
| 1b | 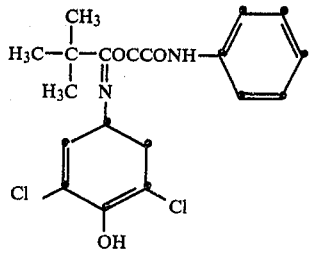 | Positive yellow image. Silver density (to IR radiation) reduced from 1.3 to 0.21) |

EXAMPLE 2

Indoaniline dyes in silver-dye bleach process

Additional activator elements were prepared as described in Example 1 with the exception that the indophenol dyes were replaced with equal molar amounts of the indoaniline dyes identified in following Table II.

Samples of the described elements were placed in face-to-face contact with a predeveloped negative silver image Element A as described. The resulting so-called sandwich, also described as a laminate, was uniformly heated in each instance on a metal block at 85° C. for 2 minutes and then heated at 125° C. for 2 minutes. The results of each process are given in following Table II with the indoaniline dye.

TABLE II

| Example No. | Dye Structure | Results |
|---|---|---|
| 2a (cyan dye) | 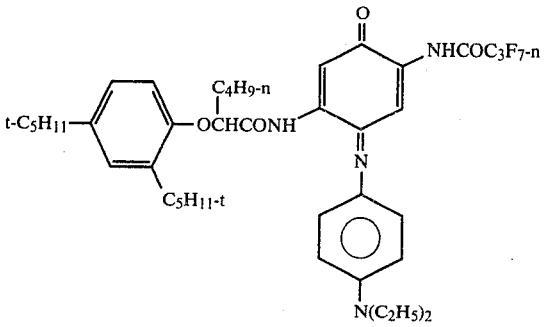 | Dye image produced |

TABLE II-continued
| Example No. | Dye Structure | Results |
|---|---|---|
| 2b (cyan dye) | 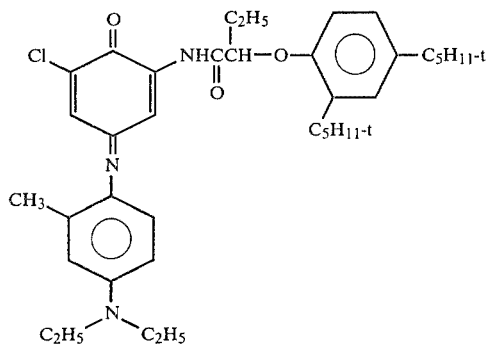 | Dmax (Ag°) = 1.3 before bleaching<br>Dmax (Ag°) = 0.2 after bleaching at 85° C. |
| 2c (cyan dye) | 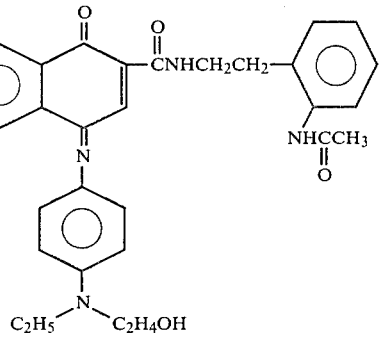 | Dmax (AG°) = 1.3 before bleaching<br>Dmax (AG°) = 0.2 after bleaching at 85°C. |
| 2d (magenta dye) | 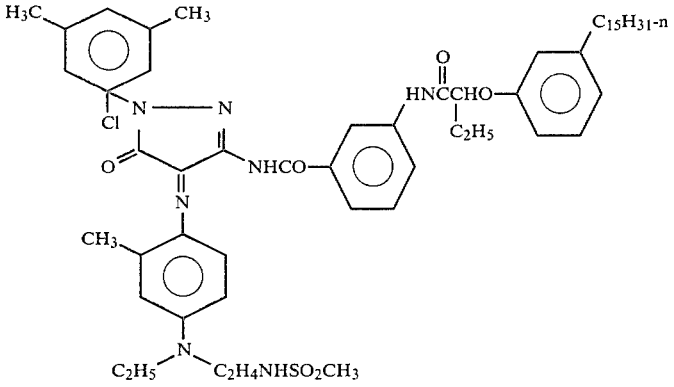 | Very weak bleaching |
| 2e (magenta dye) | 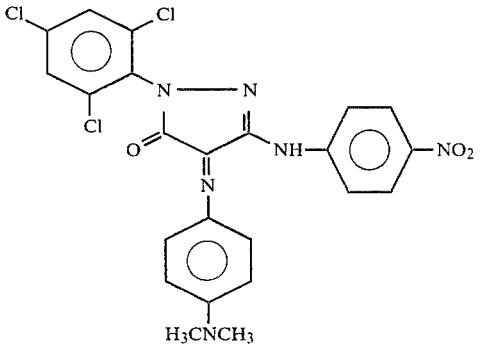 | Dmax (Ag°) = 1.3 before bleaching at<br>Dmax (Ag°) = 1.1 after bleaching |

TABLE II-continued

| Example No. | Dye Structure | Results |
|---|---|---|
| 2f (yellow dye) | 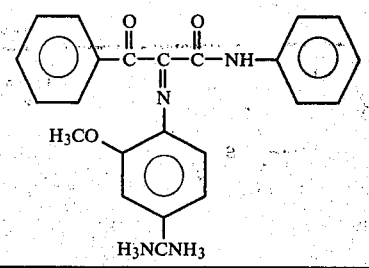 | Dmax (Ag°) = 1.3 before bleaching<br>Dmax (Ag°) = 1.0 after bleaching at 85° C. |

In each of the processed laminates of Examples 2a–2f, a positive dye image and a decrease in image silver density (IR density) was observed.

Based on the relative reduction potentials of indoaniline dyes it was observed that the cyan dyes typically bleach faster than magenta dyes in elements according to the invention. Yellow dyes, as a class, are observed to be more difficultly reduced.

EXAMPLE 3

Azoaniline dyes in a silver-dye bleach process

The procedures described in Example 1 were repeated with the exception that the indophenol dyes were replaced with equal molar amounts of the azoaniline dyes listed in following Table III.

The elements in each instance were processed as described in Example 1 with a predeveloped negative silver image in described Element A according to the procedure described in Example 2. In each so-called sandwich a positive dye image was observed and the silver image was bleached from an initial infrared density of about 1.3.

TABLE III

| Example No. | Azoaniline Dye Structure | Results |
|---|---|---|
| 3a (blue dye) | 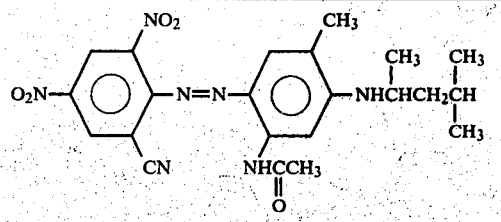 | Dmax Ag° = 0.2<br>Excellent bleaching of the dye imagewise |
| 3b (blue dye) | 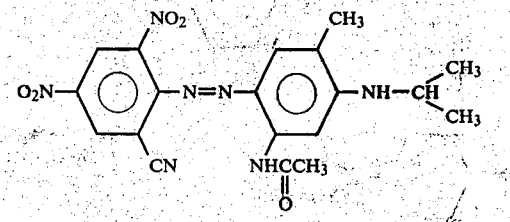 | Dmax Ag° = 0.2<br>Excellent dye bleach |
| 3c (blue dye) | 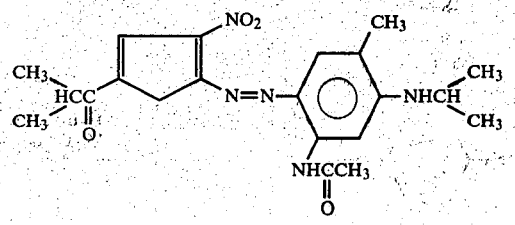 | Dmax Ag° = 0.05<br>Good dye-bleach |
| 3d (blue-cyan dye) | 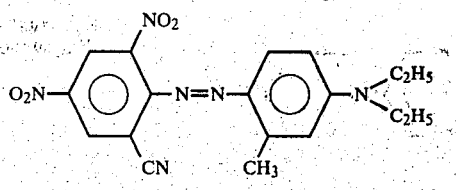 | Dmax Ag° = 0.05<br>Good dye-bleach |

TABLE III-continued

Azoaniline Dye

| Example No. | Structure | Results |
|---|---|---|
| 3e (blue dye) | 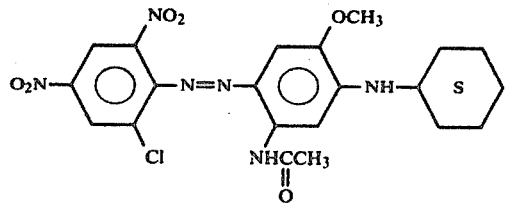 | Dmax Ag° = 0.15 Good dye-bleach |
| 3f (blue dye) | 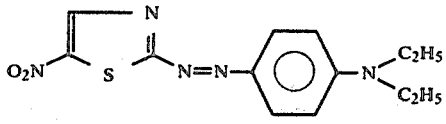 | Dmax Ag° = 0.10 Good dye-bleach |
| 3g (red dye) | 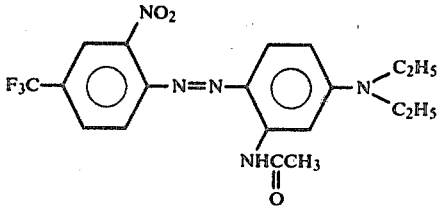 | Dmax Ag° = 0.30 Good dye-bleach |
| 3h (red dye) | 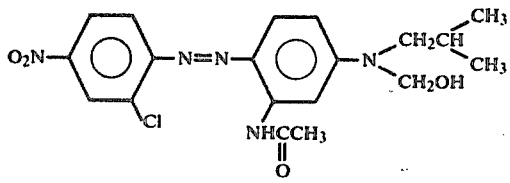 | Good Ag° bleach Good dye-bleach |
| 3i (red dye) | 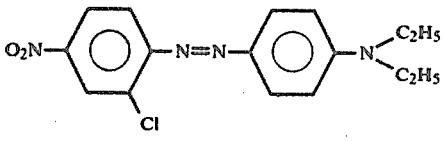 | Good Ag° bleach Good dye-bleach |
| 3j (red dye) | 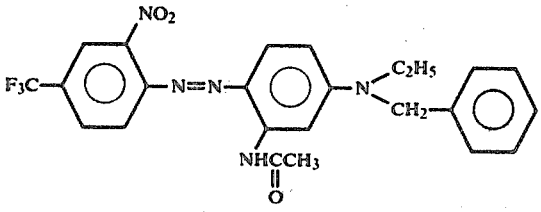 | Dmax Ag° = 0.23 Good dye-bleach |
| 3k (red dye) | 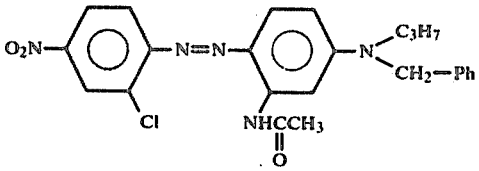 | Dmax Ag° = 0.21 Good dye-bleach |
| 3l (yellow-orange dye) | 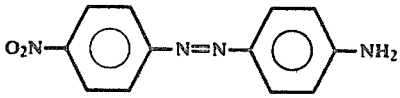 | Dmax Ag° = 0.02 Good dye-bleach |
| 3m (orange dye) | 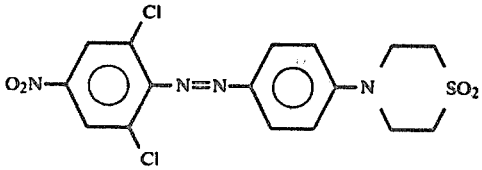 | Fair Ag° bleach Fair dye-bleach |

TABLE III-continued

| Example No. | Structure (Azoaniline Dye) | Results |
|---|---|---|
| 3n (orange dye) | 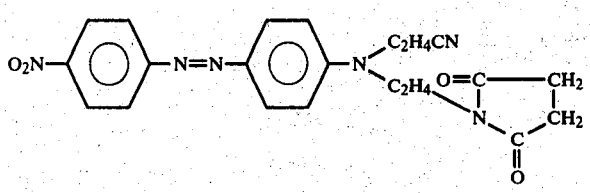 | Fair Ag° bleach<br>Fair dye-bleach |
| 3o (dark orange dye) | 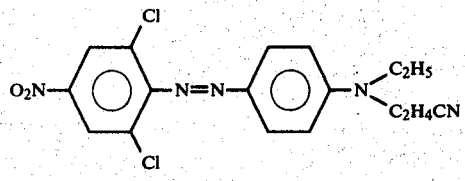 | Fair Ag° bleach<br>Fair dye-bleach |
| 3p (orange dye) | 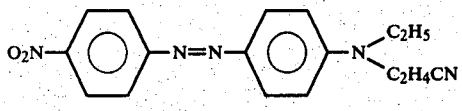 | Fair Ag° bleaching<br>Fair dye bleaching |
| 3q (magenta dye) | 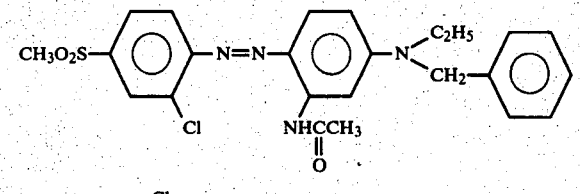 | Fair Ag° bleaching<br>Fair dye bleaching |
| 3r (brown dye) | 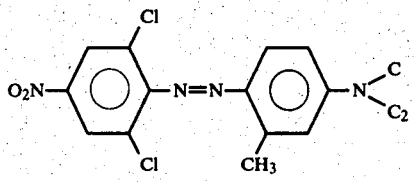 | Good Ag° bleaching<br>Good dye bleaching |
| 3s (red dye) | 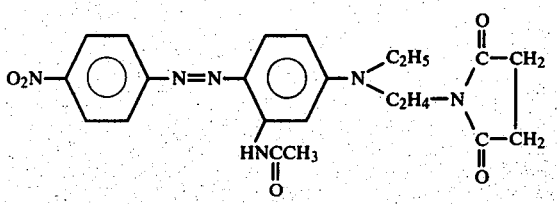 | Dmax Ag° = 0.7<br>Good dye-bleaching |
| 3t (red dye) | 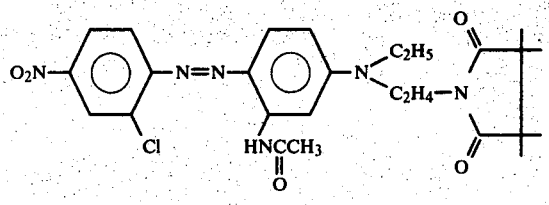 | Dmax Ag° = 0.1<br>Good dye-bleaching |
| 3u (blue dye) | 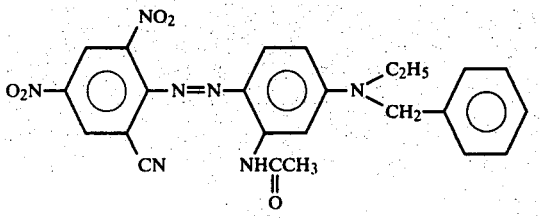 | Dmax Ag° = 0.07<br>Excellent dye-bleaching |
| 3v (magenta dye) | 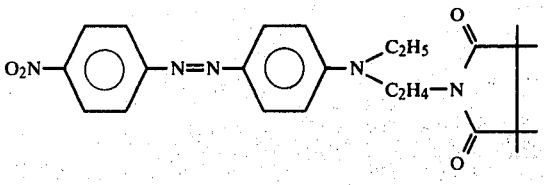 | Dmax Ag° = 0.01<br>Excellent dye-bleaching |

TABLE III-continued

| Example No. | Structure | Results |
|---|---|---|
| | Azoaniline Dye | |
| 3w (blue dye) | 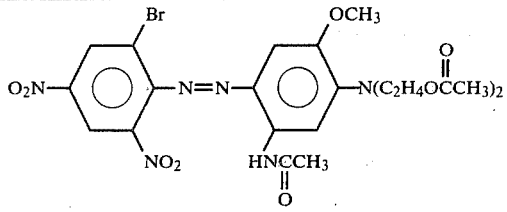 | Good Ag° bleaching<br>Good dye-bleaching |

The results from Table III indicate, among other things, that substituted phenyl azoaniline dyes having at least one electron withdrawing substituent on the phenyl azo ring undergo a desired thermal silver-dye bleach under the conditions of Example 3. Bis-azoaniline dyes are apparently much less reactive than the monoazo analog and under the conditions of Example 3 do not provide a dye image which is considered to be optionally useful under most conditions.

EXAMPLE 4

Azophenol and azonaphthol dyes in silver-dye process

Dye containing elements were prepared as described in Example 1 except that the indophenol dyes were replaced with equal molar amounts of the dyes listed in following Table IV.

Samples of each of the elements containing the dyes were placed in face-to-face contact with a predeveloped negative silver image as developed in Element B as described. The resulting so-called sandwich was heated on a metal block at 85° C. for 2 minutes and then heated at 150° C. for 30 seconds.

The results of this process are given in following Table IV:

TABLE IV

| Example No. | Dye Structure | Results |
|---|---|---|
| 4a (blue dye) | 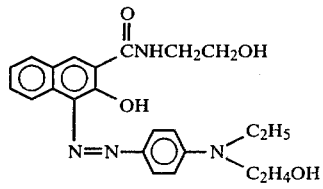 | Good bleach; positive dye image |
| 4b (yellow dye) | 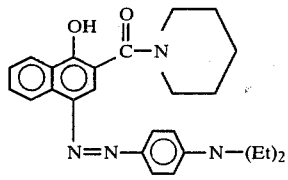 | Weak bleach; detectable positive dye image |
| 4c (magenta-red dye) (comparative example) | 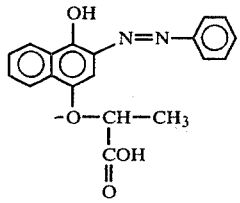 | No bleaching<br>No dye image |
| 4d (cyan-blue dye) | 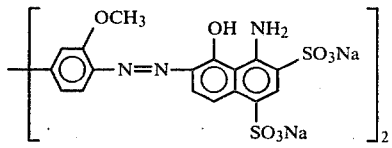 | Weak bleach; detectable positive dye image |
| 4e (magenta) (comparative example) | 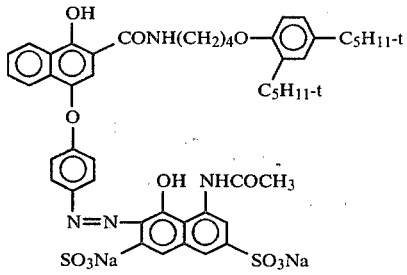 | No bleach; no dye image |

TABLE IV-continued

| Example No. | Dye Structure | Results |
|---|---|---|
| 4f (yellow dye) (comparative example) | 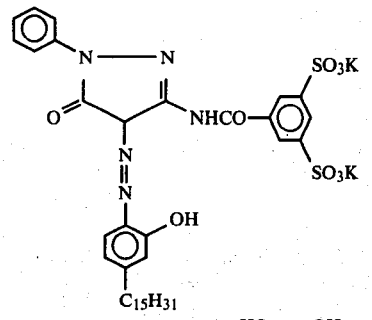 | No bleach; no dye image |
| 4g (blue dye) (comparative example) | 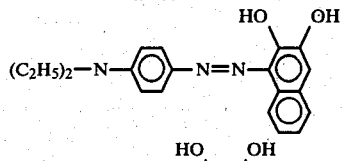 | No bleach; no dye image |
| 4h (magenta dye) (comparative example) | 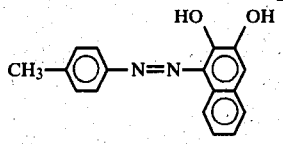 | Weak, if any bleaching; no dye image |
| 4i (yellow dye) | 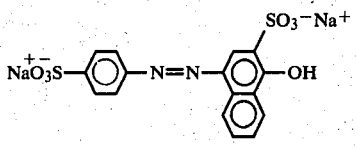 | Weak bleach; faint dye image |
| 4j (yellow dye) (comparative example) | 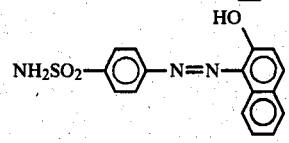 | No bleach; no dye image |
| 4k (orange dye) (comparative example) | 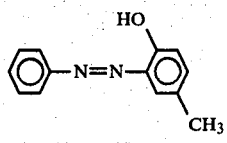 | No bleach; no dye image |
| 4l (yellow dye) (comparative example) | 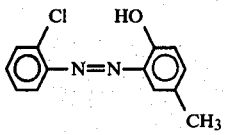 | No bleach; no dye image |
| 4m (yellow dye) (comparative example) | 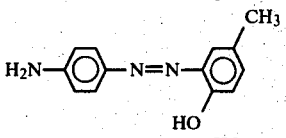 | No bleach; no dye image |
| 4n (red dye) (comparative example) | 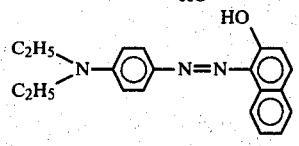 | No bleach; no dye image |
| 4o (blue dye) | 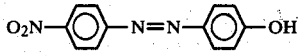 | Excellent bleach<br>Dmax (Ag°) = 0.11 after bleach<br>Dmax (Ag°) = 1.3 before bleach<br>Excellent positive dye image<br>Dmax Dye (Blue) = 1.4<br>Dmin Dye (B) = 0.2 |
| 4p | 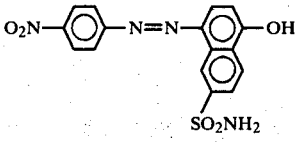 | Excellent bleach for Ag°; positive dye image |

TABLE IV-continued

| Example No. | Dye Structure | Results |
|---|---|---|
| 4q | 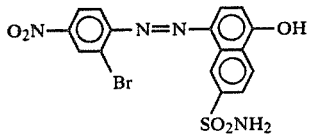 | Good Ag° and dye bleach reaction |

In addition to the dyes in Table IV, the following dyes were tested in the same manner:

TABLE IV-A

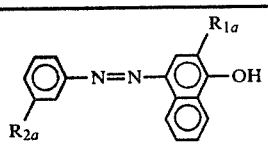

| Example No. | $R_{1a}$ | $R_{2a}$ |
|---|---|---|
| 4r | H | $-N(CH_3)_2$ |
| 4s | H | $-CH_3$ |
| 4t | H | $-H$ |
| 4u | H | $-SO_2NH_2$ |
| 4v | H | $-SO_2CH_3$ |
| 4w | H | $-Cl$ |
| 4x | H | $-NO_2$ |
| 4y | $-SO_2NHC(CH_3)_3$ | $-CH_3$ |
| 4z | $-SO_2NHC(CH_3)_3$ | $-H$ |
| 4aa | $-SO_2NHC(CH_3)_3$ | $-Cl$ |
| 4bb | $-SO_2NHC(CH_3)_3$ | $-SO_2CH_3$ |
| 4cc | $-SO_2NHC(CH_3)_3$ | $-NO_2$ |
| 4dd | $-CH_3$ | $-CH_3$ |
| 4ee | $-CH_3$ | $-H$ |
| 4ff | $-CH_3$ | $-Cl$ |
| 4gg | $-CH_3$ | $-SO_2CH_3$ |
| 4hh | $-CH_3$ | $-NO_2$ |

In each laminate containing the above dyes, bleaching of the metallic silver was apparent and positive dye images were obtained. It was observed that the rates of bleaching were related according to: $R_{1a}=-SO_2NHC(CH_3)_3>H>CH_3$ for the same $R_{2a}$ substituent, and within the series of the same $R_{1a}$ substituent, the bleaching rates were related to: $R_{2a}=NO_2>SO_2CH_3>SO_2NH_2>Cl>H>CH_3>-N(CH_3)_2$. In each laminate, however, the final amount of the silver bleached was substantially equal.

From the results of Examples 4a through 4z, it can be concluded that under the conditions of these examples (a) electron withdrawing substituents are favorable to the dye bleach reaction and (b) a 2-coupled azophenol or azonaphthol dye is a poor dye for the reaction.

EXAMPLE 5

Anthraquinone dyes in silver-dye bleach process

Dye-containing elements were prepared as described in Example 1 except that the indophenol dyes were replaced with equal molar concentrations of the anthraquinone dyes listed in following Table V.

The dye-containing elements were processed as described in Example 1 by means of predeveloped samples of Element A containing a developed negative silver image and the processing procedure described in Example 4. The results are given in following Table V:

TABLE V

| Example No. | Dye Structure | Results |
|---|---|---|
| 5a | 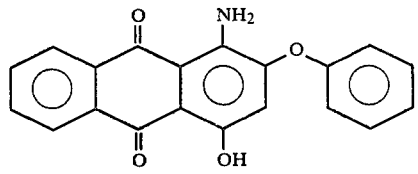 | Weak bleaching |
| 5b | 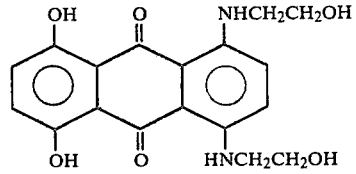 | Weak bleaching |
| 5c | 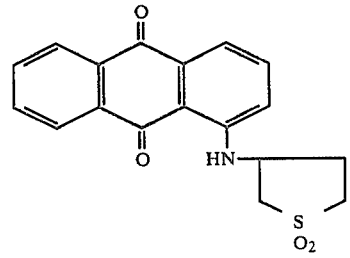 | Good bleach |

TABLE V-continued

| Example No. | Dye Structure | Results |
|---|---|---|
| 5d | 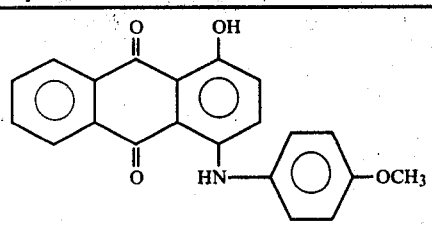 | Good bleach<br>Dmax (Ag°) IR = 1.3 before<br>Dmax (Ag°) IR = 0.5 after |
| 5e | 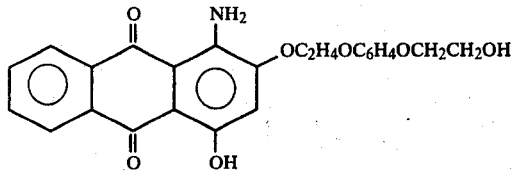 | Weak bleach |
| 5f | 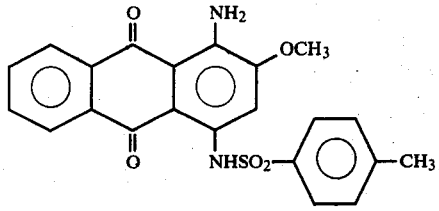 | Weak bleach |
| 5g | 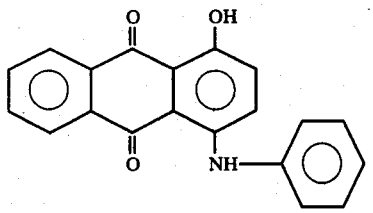 | Weak bleach |
| 5h | 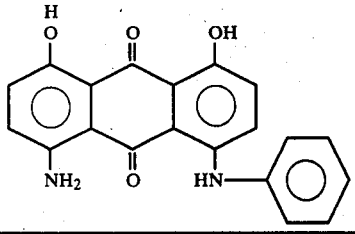 | Excellent bleach<br>Dmax (Ag°) IR = 1.3 before<br>Dmax (Ag°) IR = 0.1 after bleach<br>Dmax (Dye) R = 1.3<br>Dmin (Dye) R = 0.3<br>Dmax (Dye) G = 0.8<br>Dmin (Dye) G = 0.1<br>} after bleach |

EXAMPLE 6

Other dyes in silver-dye bleach process

Dye-containing elements were prepared as described in Example 1 except that the indophenol dyes were replaced with equal molar amounts of the dyes listed in Table VI.

The elements and dyes were tested in each instance by means of a predeveloped negative silver image in Element A. Processing conditions and procedures were as described in Example 4. In each element a positive dye image and a substantial decrease in silver density (IR density) was observed.

The results of each dye and element are summarized in following Table VI:

TABLE VI

| Example No. | Dye Structure | Results |
|---|---|---|
| 6a | 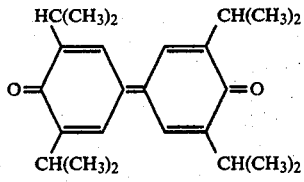 | Excellent Ag-dye bleach<br>D(Ag) before = 1.3;<br>after = 0.05<br>Positive yellow image<br>Dmax (blue) = 1.2<br>Dmin (blue) = 0.01 |
| 6b | 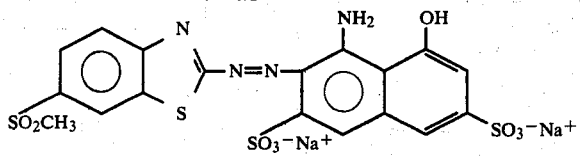 | Excellent Ag-dye bleach<br>D(Ag) before = 1.3<br>after = 0.2<br>Positive dye image<br>Dmax (R) = 0.8<br>Dmax (G) = 0.1<br>Dmin (R) = 0.05<br>Dmin (G) = 0.09 |

TABLE VI-continued

| Example No. | Dye Structure | Results |
|---|---|---|
| 6c | 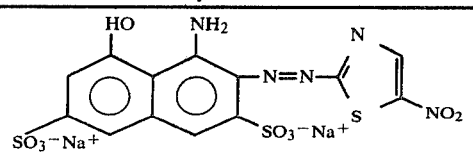 | Excellent Ag-dye bleach<br>D(Ag) before = 1.3<br>after = 0.15<br>Positive dye image<br>Dmax (R) = 0.4<br>Dmin (R) = 0.003 |
| 6d | 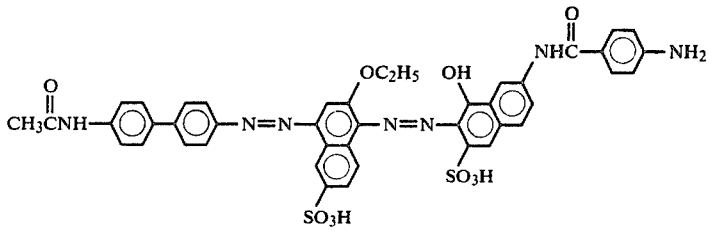 | Good Ag-dye bleach |
| 6e | 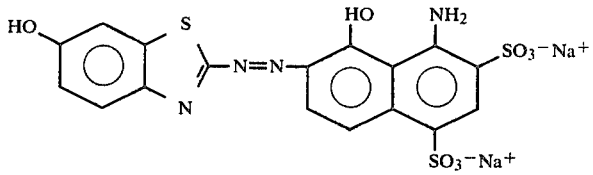 | Good Ag-dye bleach |
| 6f<br>(yellow dye) | 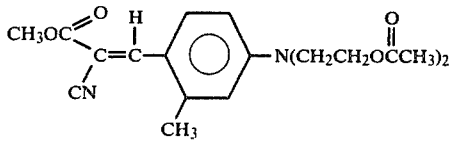 | Discernible positive image |
| 6g | 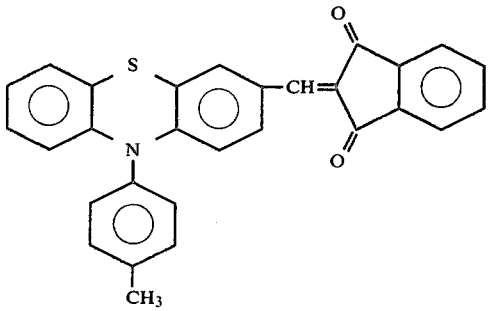 | Good Ag-dye bleach |
| 6h | 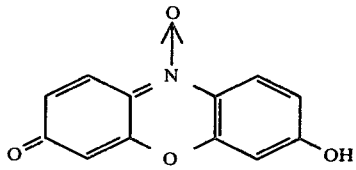 | Good Ag-dye bleach.<br>Magenta positive image. |

EXAMPLE 7

Photothermographic element containing bleachable dye

Photothermographic elements were prepared as follows: The following components were added to 9.0 ml of 2½ percent poly(vinyl butyral) (binder) in 1:1 parts by volume acetone-toluene containing 0.3 millimoles of behenic acid, 0.3 millimoles of silver behenate (oxidizing agent) and 0.3 millimoles of a silver bromoiodide photographic emulsion peptized with poly(vinyl butyral) and sensitized with a spectral sensitizing dye to the red region of the electromagnetic spectrum:

1,1'-bi-2-naphthol (reducing agent): 100 mg 1-(2H)-phthalazinone (development accelerator): 20 mg bleachable dye (as listed in following Table VII): 35 mg (0.075 millimoles)

The resulting composition was coated at a 6.0 mil wet coating thickness on a 4 mil thick poly(ethylene terephthalate) film support.

TABLE VII

| Example No. | Dye |
|---|---|
| 7a<br>(blue dye) | 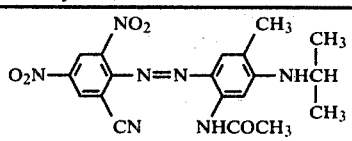 |
| 7b<br>(magenta dye) | 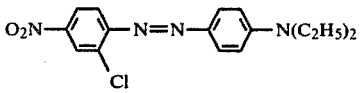 |
| 7c<br>(magenta dye) | 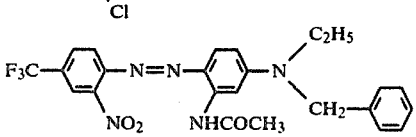 |

TABLE VII-continued

| Example No. | Dye |
|---|---|
| 7d (yellow dye) | $O_2N$—⟨⟩—N=N—⟨⟩—$NH_2$ |

Examples of each of the photothermographic elements were permitted to dry and then imagewise exposed through a graduated density test object using a suitable filter. The imagewise exposure was to light (3200° K.) for 5 seconds at a distance of 15 inches to produce a developable latent silver image in the photothermographic element. The exposed photothermographic elements were processed by uniformly heating them by contacting the support side of the element for 15 seconds with a metal block heated to 125°C. The resulting photothermographic element contained a developed negative silver image and a uniform distribution of dye in the element.

The resulting photothermographic element was then placed in face-to-face contact with an element consisting of a polyester film support having a layer containing the following components: 500 mg of methyl anisate, 250 mg of the silver halide complexing agent described in Example 1, 175 mg of suberic acid (this concentration does not substantially reduce the pH of the layer) and 9 ml of 2.5 percent poly(vinyl butyral) in 1:1 methanol-toluene. The coating containing the silver halide complexing agent was permitted to dry before contacting it with the photothermographic element. The resulting so-called sandwich of the layer containing the silver halide complexing agent and the photothermographic element containing the silver image and bleachable dye was heated for 2 minutes by contacting the support side of the photothermographic element with a metal block at a temperature of 85° C.

In each instance the silver image was bleached and the element stabilized against increased printout in the background areas by the described silver halide complexing agent. In addition, the bleachable dye was bleached in proportion to the developed silver image producing a positive dye image. The described film support was transparent and as a result of dye image could be viewed as a transparency.

EXAMPLE 8

One-step thermal silver-dye bleaching

A photothermographic element was prepared containing a light-sensitive, heat developable, thermally bleachable, hydrophobic layer and a hydrophilic overcoat layer containing a silver halide complexing concentration of a silver halide complexing agent. This photothermographic element was prepared in the following manner: a poly(ethylene terephthalate) film support was first coated at a 6 mil wet coating thickness and at 54° C. with the following composition:

| | | |
|---|---|---|
| behenic acid | 0.3 | millimoles |
| silver behenate (oxidizing agent) | 0.3 | millimoles |
| photosensitive silver bromoiodide (sensitized to the red region of the spectrum with a spectral sensitizing dye and con- | 0.3 | millimoles |

-continued

| | | |
|---|---|---|
| taining poly(vinyl butyral) as a peptizer) | | |
| 1,1'-bi-2-naphthol (reducing agent) | 100 | milligrams |
| 1-(2H)-phthalazinone | 20 | milligrams |
| azoaniline dye represented by the structure: | 0.075 | millimoles |
| $F_3C$—⟨⟩—N=N—⟨⟩—N($C_2H_5$)—$CH_2$—⟨⟩ | | |
| 2.5% poly(vinyl butyral) in 1:1 acetone-toluene (binder) | 9.0 | milliliters |

The resulting coating was permitted to dry and then was overcoated with a 3 mil wet coating thickness of a composition containing 3% by weight aqueous solution of poly(vinyl alcohol) containing 50 milligrams of the silver halide complexing agent:

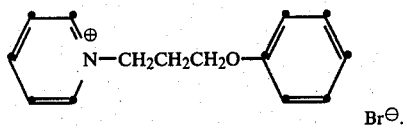

The resulting photothermographic element was permitted to dry under ambient conditions and then imagewise exposed as described in Example 7 to provide a developable latent silver image in the photothermographic element. The resulting photothermographic element was then uniformly heated by contacting the support side of the element for 90 seconds with a metal block heated to 125° C. A visible negative silver image was developed in the photothermographic element within 10 to 15 seconds.

When the heating of the photothermographic element was continued, the silver image was bleached and the dye in the exposed areas of the element was reductively destroyed resulting in a positive magenta dye image.

EXAMPLE 9

Other silver halide complexing agents

The following compositions were mixed and then coated at a 6 mil wet coating thickness on a poly(ethylene terephthalate) film support at 54° C.:

| | | |
|---|---|---|
| 2.5% poly(vinyl butyral) (binder) in 1:1 by volume methanol-toluene | 9.0 | ml |
| acetone | 2.0 | ml |
| methyl anisate (thermal solvent) | 1.0 | g |
| silver halide complexing agent (as listed in Table VIII) | 0.82 | mmoles |
| yellow dye (as given in Example 1) | 0.15 | mmoles |

The resulting dye activator element was then placed in face-to-face contact with a photothermographic element containing a predeveloped silver negative image. The photothermographic element was Element A as described. The resulting so-called sandwich was uniformly heated as described in Example 1. The results of this heating step are given in following Table VIII:

TABLE VIII

| Example No. | Complexing Agent | Results |
|---|---|---|
| 9a (comparative example) | 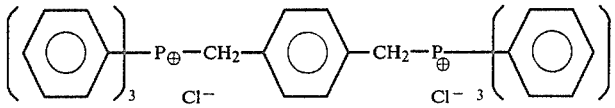 (p-Xylene-α,α'-bis(triphenyl)-phosphonium)chloride) | Good yellow positive dye image indicating silver-dye bleach reaction had occured. |
| 9b (comparative example) | 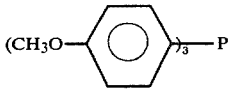 (Tris(p-anisyl)phosphine) | Silver-dye bleach proceeded partially |
| 9c (comparative example) | $[(CH_3)_2N]_3P$ (Hexamethylphosphorus triamide) | Silver-dye bleach went to completion |
| 9d (comparative example) | $NCCH_2CN$ (Malononitrile) | Silver-dye bleach went to completion |
| 9e (comparative example) | 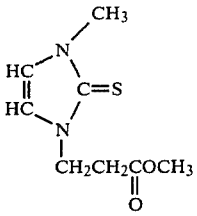 3-(2-Carboxymethoxyethyl) 1-methylimidazoline-2-thione | Silver-dye bleach went to completion |
| 9f | 0.1M Pyrazine + 0.8 silver halide complexing agent A (See Example 1) | Better silver-dye-bleach than either silver halide complexing agent A or pyrazine alone |

Example 9*a* suggests that certain phosphonium halides can be useful as silver halide complexing agents under the conditions of the example. None of the silver complexing agents tested produced a more useful dye image than the dye image produced with described complexing agent A. Example 9*f* suggests that in some cases improved silver-dye bleach results can be produced when a combination of pyrazine with a silver halide complexing agent according to the invention is used.

EXAMPLE 10

Silver halide complexing concentration of the silver halide complexing agent It is necessary according to the invention that a silver halide complexing concentration of the silver halide complexing agent be used in the described elements. To demonstrate this a series of elements was prepared. In each instance a 6 mil wet coating was applied to a poly(ethylene terephthalate) film support. The coating composition contained the following components:

| | |
|---|---|
| 2.5% poly(vinyl butyral) (1:1 acetone-toluene) (binder) | 9.0 ml |
| methyl anisate (thermal solvent) | 500 mg |
| azo dye represented by the structure: (concentration varied) | |

-continued

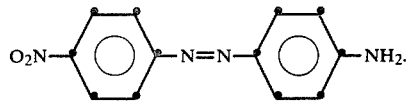

The resulting element was tested by means of laminating it to a predeveloped negative silver image in Element A. The processing procedure was as described in Example 1. The silver halide complexing agent used was complexing agent A as described in Example 1.

When the described element contained no silver halide complexing agent, a very weak silver bleach was observed but no dye was destroyed imagewise. When 0.1 mmoles of the silver halide complexing agent was used, the resulting silver bleach was very weak and no dye was destroyed imagewise. When 0.2 mmoles of the silver halide complexing agent was used, fair bleaching of the silver was observed and a detectable positive dye image was produced. When 0.4 mmoles of the silver halide complexing agent was added, excellent bleaching of the silver image and a good positive dye image with low Dmin to blue light was observed. Finally, when 0.8 mmoles of the complexing agent was added, the results were observed similar to those in which the element contained 0.4 mmoles of the complexing agent. The optimum concentration of the silver halide complexing agent will depend upon the factors described including the desired image, particular silver halide complexing agent, processing conditions, particular photothermographic element and the like.

EXAMPLE 11

Suberic acid effect

A series of coatings was prepared by coating a poly(ethylene terephthalate) film support at a 6 mil wet coating thickness with the following composition:

| | |
|---|---|
| 2.5% poly(vinyl butyral) (1:1 acetone-toluene) (binder) | 9.0 ml |
| methyl anisate (thermal solvent) | 1.0 g |
| silver halide complexing agent A | 250 mg (0.8 mmoles) |
| yellow dye as described in Example 1 | 58 mg (0.15 mmoles) |
| Suberic acid (concentration varied) | |

The resulting element was permitted to dry and then placed in face-to-face contact with a predeveloped negative silver image in a processed Element A as described. The resulting so-called sandwich was heated as described in Example 1. In the described element when no suberic acid was added to the composition containing the silver halide complexing agent, a positive dye image was produced by the silver-dye bleach process and a weak silver bleaching was observed. When 0.5 mmoles of suberic acid was added to the composition containing the yellow dye, a positive dye image was observed but considerable loss of density to blue light was also observed compared to the element containing no suberic acid. Silver density in the element containing suberic acid decreased from 1.3 to 0.6. In elements containing respectively 1.0, 2.0 and 3.0 mmoles of suberic acid, the silver bleaching was as described in the element containing 0.5 mmoles of suberic acid but dye density was lost overall, that is dye density to blue light was nearly zero overall. The results indicate that the presence of suberic acid can adversely affect the desired results of the element under conditions of the example.

EXAMPLE 12

Effects of acidity

A series of elements was prepared by coating a poly(ethylene terephthalate) film support with the composition containing the silver halide complexing agent as described in Example 11 except that the yellow dye was replaced with the dye represented by the structure:

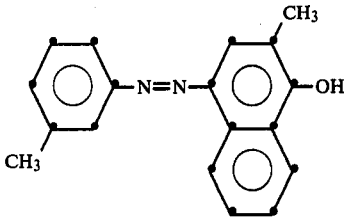

and various levels and types of acids were added to the composition containing the dye. The resulting elements were permitted to dry and then placed in face-to-face contact with a predeveloped silver negative image in elements corresponding to Element A. The resulting so-called sandwich in each instance was heated uniformly at a constant temperature while measuring the change in reflection infrared density with time. Rates of bleaching were calculated from density (D) versus time (t) curves and considered as a type of first order reaction rate constant ($K_1$) as functions of the acidity in the so-called sandwich. The later acidity values were measured in the heated coating at 127° C. with a suitable high temperature glass electrode. The acidity was measured as the potential difference ($\Delta E$) between the test coating containing the acid and the reference coating. In the first instance, for the coating containing no additional acid the $\Delta E$-acidity level was zero. In the second case, 0.1 mmoles of suberic acid was added to provide a $\Delta E$-acidity level of 350. In the third case, 0.1 mmoles of para-chlorobenzenesulfonic acid was added to provide a $\Delta E$-acidity level of 440. A fourth case involved the addition of 1.0 mmoles of para-chlorobenzenesulfonic acid to provide a $\Delta E$-acidity level of 650. A further sample was observed in which 5.0 mmoles of para-chlorobenzenesulfonic acid was added. The results of this sample indicated a $\Delta E$-acidity level about 750.

The results of these tests indicate that below a $\Delta E$-acidity level of about 750 the particular dye is unprotonated and has a yellow color. For the unprotonated dye, the rate of bleaching is unaffected by large changes in the acidity level. Above 750 $\Delta E$-acidity level, the dye is protonated and its hue shifted bathochromically. For the protonated dye, the rate of bleaching suddenly increases as observed in other silver-dye bleach reactions. The elements of the present invention concern compositions containing the unprotonated dyes.

The photographic dye images produced according to the invention can remain in the layers in which the dye was originally added or the dye images can be transferred to a dye image receiving layer integral with the described photothermographic element or to a separate dye receiving element. In some instances it is desirable to stabilize the unexposed photosensitive silver halide in the photothermographic element to produce reduced background printup as a result of further exposure of the photosensitive silver halide to light and to thermally bleach any remaining image silver in the photothermographic element. The stabilization of the photosensitive silver halide can be produced by silver haide stabilizers and stabilization processes known in the photographic art.

In some embodiments of the invention it is highly desirable to have the imagewise distribution of dyes produced upon processing transferred to a suitable image receiver. In such embodiments a variety of dyes can be useful because the dyes which were bleached in their leuco form (colorless form) were found to diffuse significantly slower than their unbleached, colored form. On separation of the image receiver from the remaining portions of the photothermographic element, no leuco form of the dye is observed to be present. This diffusion rate difference in the hydrophobic elements according to the invention was unexpected because no significant differences in rate are evident from such dyes in aqueous photographic materials.

EXAMPLE 13

A photothermographic element (designated as Element C) was prepared by coating a poly(ethylene terephthalate) film support with a polymeric stripping layer containing 120 milligrams of copoly(isopropyl acrylate-propylacrylate) (1:1 weight ratio) per 929 square centimeters of film support.

The resulting stripping layer was then overcoated with a non-aqueous coating composition at a wet coating thickness of 6.0 mils. This non-aqueous composition was prepared and coated as described in the preparation of Element A and contained a photosensitive silver bromoiodide emulsion, 1,1'-bi-2-naphthol (reducing agent), silver behenate, behenic acid and a poly(vinyl butyral) binder.

The resuting element was imagewise exposed and processed as described in Example 7. A positive dye image was observed in the film support after removal of the stripping layer and the light sensitive layer.

EXAMPLE 14

A sample of the described Element C was imagewise exposed and thermally processed by contacting the element for 20 seconds with a metal block at a temperature of 135° C.

Separate samples of the processed element, which contained negative silver images, were placed in face-to-face contact with a sample of each of the dye-containing elements described in Example 3 which contained an azoaniline dye, a silver halide complexing agent, a thermal solvent and the hydrophobic binder.

Upon processing, a silver-dye bleach reaction was observed. The so-called sandwich in each instance was uniformly heated for 2 minutes at 85° C. and then further heated to 125° C. for one minute. After heating the described elements were separated and the stripping layer was separated from the photosensitive emulsion layer. A well-defined positive dye image was observed in each of the poly(ethylene terephthalate) film supports.

EXAMPLE 15

The procedure described in Example 14 was repeated with the exception that the dye-containing layer described in Example 6 was used in place of the dye-containing layer of Example 14. In each instance a positive dye image was observed in the film support after processing and removal of the stripping layer in the light sensitive layer.

EXAMPLE 16

Photothermographic elements were prepared by overcoating the stripping layer described in Example 13 with the non-aqueous coating compositions prepared and coated as described in Example 7 . In each case the overcoat layer contained a photosensitive silver bromoiodide emulsion, a reducing agent, silver behenate, behenic acid, a development accelerator, a hydrophobic binder and the specified bleachable dye. Samples of the resulting photothermographic element were imagewise exposed and processed as described in Example 7. In each instance a positive dye image was observed in the film support after processing and removal of the stripping layer and the light sensitive layer.

The invention has been described in detail with particular reference to preferred embodiments thereof, but it will be understood that variations and modifictions can be effected within the spirit and scope of the invention.

What is claimed is:

1. In a dry physical development photothermographic element for a dry, thermal silver-dye bleach process said element comprising a support having thereon (A) a first layer comprising photographic silver halide and (B), contiguous to said first layer, a second layer comprising a binder, a silver halide complexing concentration of a silver halide complexing agent and a thermal solvent, said element also comprising a bleachable dye in reactive association with the photographic silver halide, the improvement wherein said element comprises (a) as said complexing agent an organic ammonium chloride, bromide or iodide.

2. A photothermographic element as in claim 1 wherein said improvement comprises the combination of said (a) with (b) in said first layer, (i) an oxidation-reduction image-forming combination comprising (I) an organic silver salt oxidizing agent, with (II) a reducing agent, and (ii) a synthetic, hydrophobic polymeric binder, and (c) as binder in the second layer a synthetic, hydrophobic polymeric binder.

3. A photothermographic element as in caim 1 wherein said complexing agent consists essentially of a compound selected from the group represented by the structures

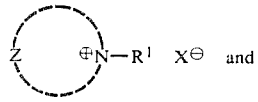

and

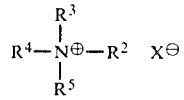

wherein

Z represents the atoms selected from carbon atoms and nitrogen atoms which, together with N, are necessary to complete a 5-membered or 6-membered heterocyclic nucleus, $R^1$ is alkyl containing 1 to 15 carbon atoms or aryl containing 6 to 10 carbon atoms, $R^2$, $R^3$, $R^4$ and $R^5$ are, individually, alkyl containing 1 to 4 carbon atoms.

4. A photothermographic element as in claim 1 wherein said complexing agent consists essentially of a pyridinium bromide.

5. A photothermographic element as in claim 2 wherein said organic silver salt oxidizing agent consists essentially of a salt of a long-chain fatty acid.

6. A photothermographic element as in claim 2 wherein said organic silver salt oxidizing agent consists essentially of silver behenate.

7. A photothermographic element as in claim 2 wherein said reducing agent is a phenolic, silver halide developing agent.

8. A photothermographic element as in claim 2 wherein said binder in the first layer consists essentially of poly(vinyl butyral).

9. A photothermographic element as in claim 1 also comprising a dye mordant for said bleachable dye.

10. A photothermographic element as in claim 1 wherein said support comprises a polymer that is a dye image receiver for said bleachable dye.

11. In a dry physical development photothermographic element for a dry, thermal silver-dye bleach process said element comprising a support having thereon (A) a first layer comprising photographic silver halide and (B), contiguous to said first layer, a second layer comprising a polymeric binder, a silver haide complexing concentration of a silver halide complexing

UNITED STATES PATENT AND TRADEMARK OFFICE

CERTIFICATE OF CORRECTION

PATENT NO. : 4,235,957

DATED : November 25, 1980

INVENTOR(S) : Carl F. Kohrt and Roland G. Willis

It is certified that error appears in the above-identified patent and that said Letters Patent are hereby corrected as shown below:

Column 4, line 56 & 57 reading "photo-thermographic" should read --photothermographic--.

Column 11, line 45 reading "zylthio-$^{1}$,2,4-triazole" should read --zylthio-1,2,4-triazole--.

28. A process as in claim 27 wherein said dye image is thermally transferred to a dye image receiver.

29. A process as in claim 27 wherein said dye image is thermally transferred to a polyester dye image receiver.

30. A process as in claim 27 wherein said silver halide complexing agent consists essentially of a compound selected from the group represented by the structures:

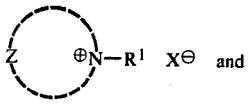

and

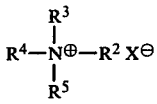

wherein

Z represents the atoms selected from carbon atoms and nitrogen atoms which, together with N, are necessary to complete a 5-membered or 6-membered heterocyclic nucleus, $R^1$ is alkyl containing 1 to 15 carbon atoms or aryl containing 6 to 10 carbon atoms, $R^2$, $R^3$, $R^4$ and $R^5$ are, individually, alkyl containing 1 to 4 carbon atoms.

31. A process as in claim 27 wherein said complexing agent consists essentially of a pyridinium bromide.

32. A process of thermally dye bleaching an image in a dry physical development photothermographic silver halide element comprising, in the absence of a silver-dye bleach catalyst, (I) contacting said image with a dry activator element comprising a support having thereon at least one layer comprising (a) a hydrophobic, polymeric binder, (b) a silver halide complexing agent consisting essentially of a compound represented by the formula:

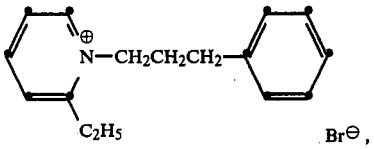

(c) a thermal solvent and (d) a bleachable indophenol dye represented by the formula:

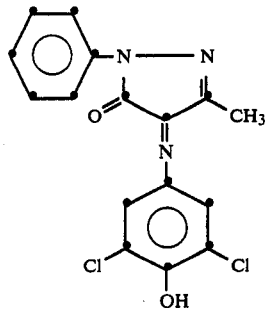

and then (II) heating the resulting laminate to a temperature within the range of about 90° C. to about 210° C. until a dye image is produced.

33. A process of thermally dye bleaching an image in a dry physical development photothermographic silver halide element comprising, in the absence of a silver-dye bleach catalyst, (I) contacting said image with a dry activator element comprising a support having thereon at least one layer comprising (a) a hydrophobic, polymeric binder, (b) a silver halide complexing concentration of a silver halide complexing agent consisting essentially of a compound represented by the formula:

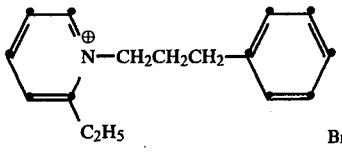

(c) a thermal solvent and (d) a bleachable azoaniline dye represented by the formula:

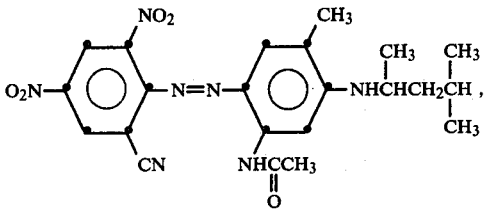

and then (II) heating the resulting laminate to a temperature within the range of about 90° C. to about 210° C. until a dye image is produced.

34. In a dry, thermal silver dye-bleach imaging process, the novel step compising complexing silver by means of an organic ammonium chloride, bromide or iodide silver halide complexing agent.

35. A process as in claim 34 wherein said silver halide complexing agent consists essentially of a compound selected from the group represented by the structures

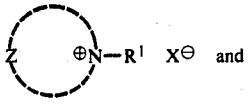

and

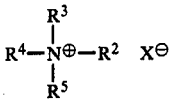

wherein

Z represents the atoms selected from carbon atoms and nitrogen atoms which, together with N, are necessary to complete a 5-membered or 6-membered heterocyclic nucleus, $R^1$ is alkyl containing 1 to 15 carbon atoms or aryl containing 6 to 10 carbon atoms, $R^2$, $R^3$, $R^4$ and $R^5$ are, individually, alkyl containing 1 to 4 carbon atoms.

36. A process as in claim 34 wherein said silver halide complexing agent consists esentially of pyridinium bromide.

* * * * *

UNITED STATES PATENT AND TRADEMARK OFFICE

CERTIFICATE OF CORRECTION

PATENT NO. : 4,235,957

DATED : November 25, 1980

INVENTOR(S) : Carl F. Kohrt and Roland G. Willis

It is certified that error appears in the above-identified patent and that said Letters Patent are hereby corrected as shown below:

Column 4, line 56 & 57 reading "photo-thermographic" should read --photothermographic--.

Column 11, line 45 reading "zylthio-$^{1}$,2,4-triazole" should read --zylthio-1,2,4-triazole--.

UNITED STATES PATENT AND TRADEMARK OFFICE

CERTIFICATE OF CORRECTION

PATENT NO. : 4,235,957

DATED : November 25, 1980

INVENTOR(S) : Carl F. Kohrt and Roland G. Willis

It is certified that error appears in the above-identified patent and that said Letters Patent are hereby corrected as shown below:

Column 18, line 14, the formula reading

Ia

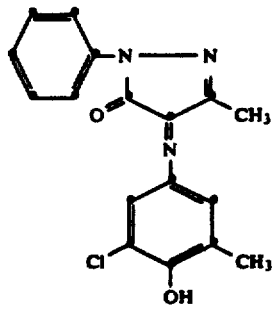

Positive magenta image
Dye density (to green light): Dmax 2.3 Dmin 1.6
Silver density (to IR radiation) reduced from 1.3 to 0.3 should read

Ia

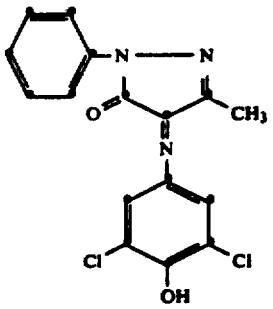

Positive magenta image
Dye density (to green light): Dmax 2.3 Dmin 1.6
Silver density (to IR radiation) reduced from 1.3 to 0.3

UNITED STATES PATENT AND TRADEMARK OFFICE

CERTIFICATE OF CORRECTION

PATENT NO. : 4,235,957

DATED : November 25, 1980

INVENTOR(S) : Carl F. Kohrt and Roland G. Willis

It is certified that error appears in the above-identified patent and that said Letters Patent are hereby corrected as shown below:

Column 48, line 68 reading " 210°" should read --210°C--.

Signed and Sealed this

*Third* Day of *May 1983*

[SEAL]

*Attest:*

GERALD J. MOSSINGHOFF

*Attesting Officer*

*Commissioner of Patents and Trademarks*